US005517777A

United States Patent [19]

Gagnon, Jr.

[11] Patent Number: 5,517,777

[45] Date of Patent: May 21, 1996

[54] PLAYING CARDS WITH EDGE CARRIED INDICIA

[76] Inventor: Thomas A. Gagnon, Jr., 1116 S. Courtland Ave., Kokomo, Ind. 46902

[21] Appl. No.: 328,414

[22] Filed: Oct. 25, 1994

[51] Int. Cl.[6] ..... B42F 21/08

[52] U.S. Cl. ..... 40/384; 273/293; 283/38

[58] Field of Search ..... 40/491, 362, 375, 40/539, 384; 273/292, 293; 283/42, 38, 70, 117

[56] References Cited

U.S. PATENT DOCUMENTS

| | | | |
|---|---|---|---|
| 942,465 | 12/1909 | Sauer . | |
| 1,034,402 | 7/1912 | Hardy . | |
| 1,474,572 | 11/1923 | Whitstock . | |
| 1,727,800 | 9/1929 | Albert . | |
| 2,369,173 | 2/1945 | Oppenheimer | 283/42 |
| 2,680,630 | 6/1954 | Machol | 283/38 |
| 2,850,825 | 9/1958 | Grants . | |
| 3,674,616 | 7/1972 | Howard . | |
| 4,119,322 | 10/1978 | Weigl | 273/293 |
| 4,352,554 | 10/1982 | Kaye et al. | 283/38 X |
| 4,949,999 | 8/1990 | Ke-hui | 283/42 X |
| 5,127,677 | 7/1992 | Merry | 283/38 X |
| 5,429,391 | 7/1995 | White, II | 283/70 |

FOREIGN PATENT DOCUMENTS

| | | | |
|---|---|---|---|
| 2291039 | 6/1976 | France | 283/38 |

*Primary Examiner*—Peter M. Cuomo
*Assistant Examiner*—James O. Hansen
*Attorney, Agent, or Firm*—Woodard, Emhardt, Naughton, Moriarity & McNett

[57] ABSTRACT

A deck of playing cards with a changing message provided on the edge thereof. In the preferred embodiment, the cards are tapered with a portion of the cards having a first set of letters provided on the edge thereof and with the remaining portion of the cards having a second set of letters on the edge thereof. A first message is provided when the first set of letters are adjacent the second set of letters whereas a second message is provided when the two sets are positioned apart. In an alternate embodiment, the first portion of cards have a narrow width whereas the second portion of cards have a wide width.

15 Claims, 3 Drawing Sheets

PLAYING CARDS WITH EDGE CARRIED INDICIA

BACKGROUND OF THE INVENTION

1. Field of the Invention

This invention is in the field of devices for displaying changeable messages.

2. Description of the Prior Art

The present invention includes the appearance and disappearance of a message on the edge of a plurality of planar members arranged in a stack. The stack can take the form of a deck of cards.

In regards to changeable pictures or messages appearing on a deck of playing cards, a number of patents have been granted. For example, U.S. Pat. No. 1,727,800 issued to C. E. Albert discloses a deck of cards including colored edges permitting the dealer to immediately detect a card turned face up and to single it out in the deck. A similar technique is disclosed in U.S. Pat. No. 1,034,402 issued to J. F. Hardy which discloses a deck of tapered playing cards to facilitate the ready grouping and playing of the cards.

In regards to other messaging devices, a number of techniques have been used to allow for a message to be changed. One technique is to provide a plurality of triangular configured upright members arranged in a horizontal stack. As the upright members are rotated moving a new outer surface of the member into view, a different message is displayed. U.S. Pat. No. 2,850,825 issued to Grants discloses a display sign including a plurality of slats to display a different message depending upon the viewing angle. U.S. Pat. No. 1,474,572 issued to O. M. Whitstock shows a device for displaying different pictures by shifting the cage or surface holding the pictures. U.S. Pat. No. 942,465 issued to H. O. Sauer discloses a movable picture mount having a changeable picture as the mount is compressed. U.S. Pat. No. 3,674,616 issued to L. M. Howard discloses a carpet or pile presenting different pictorial representations depending upon the viewing angle.

SUMMARY OF THE INVENTION

One embodiment of the present invention includes a deck of playing cards separated into a first group and a second group. Each group includes an outer edge with indicia thereon. In one embodiment, the second group of cards are narrow and have a width less than the first group of cards which are wide. A first message is displayed by moving the edge of the narrow cards having the indicia thereon backward or apart from the edge of the wide cards having indicia thereon. A second message is provided when the edges having indicia thereon of both groups of cards are aligned. In another embodiment, the first group and second group of cards are identical in size but are tapered. A first message is provided when the first group of cards is aligned with the second group of cards whereas a second message is provided when the taper of the first group of cards extends in a direction opposite to the taper of the second group of cards.

DESCRIPTION OF THE PREFERRED EMBODIMENTS

Figure 1:
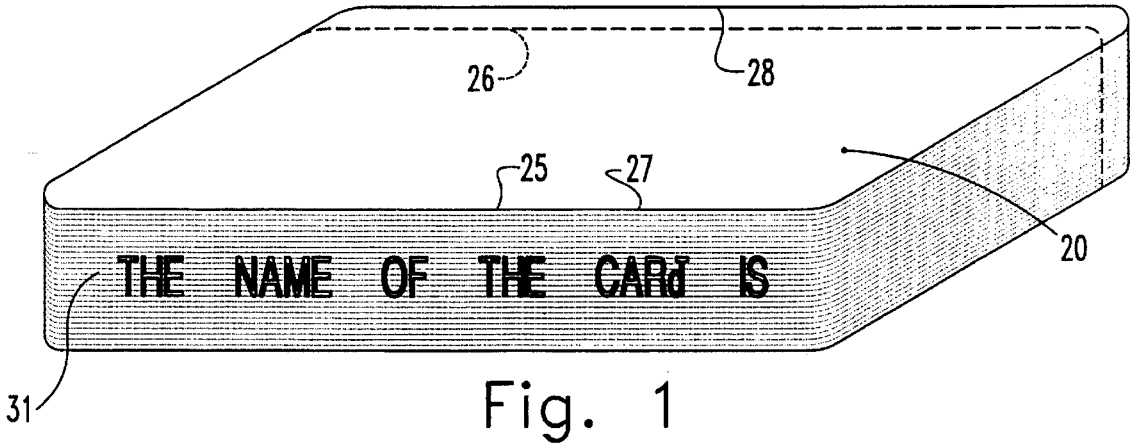
FIG. 1 is a perspective view of a first alternate embodiment of a deck of playing cards with the edges of the playing cards closest to the viewer all being aligned together.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
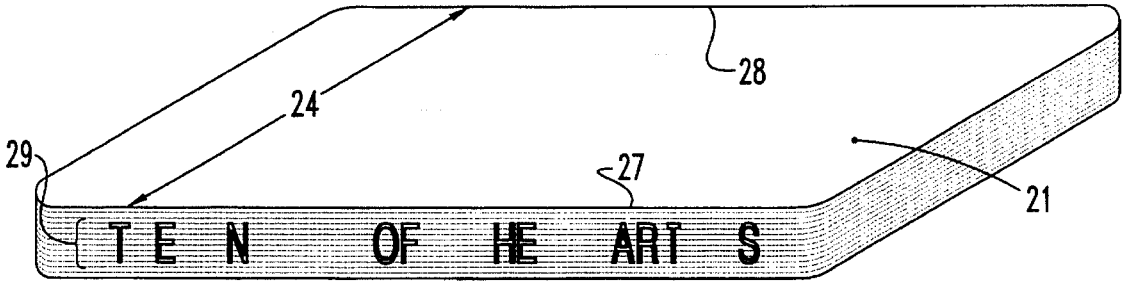
FIG. 2 is a perspective view a first group of wide playing cards contained in the deck of FIG. 1.
Figure 3:
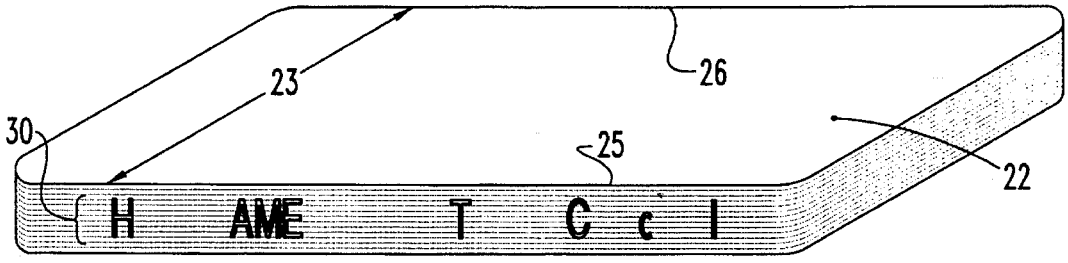
FIG. 3 is a perspective view of a group of narrow playing cards contained in the deck of FIG. 1.

Referring now more particularly to FIG. 1, there is shown the alternate embodiment of a deck of playing cards 20 which consists of 52 cards. One half of the cards, or 26 cards are depicted in FIG. 2 forming a first group 21 whereas the remaining one half portion, or 26 cards, is shown in FIG. 3 as a second group of cards 22. The cards in groups 21 and 22 have identical lengths; however, the cards of group 21 are wider than the cards in group 22. That is, the distance 23 between the opposite longitudinally extending edges 25 and 26 of the cards in group 22 is less than the distance 24 extending between the opposite longitudinally extending edges 27 and 28 of the cards in group 21.

A first indicia 29 is provided on edges 27 of the cards in group 21. Indicia 29 in the embodiment shown in FIG. 2 takes the form of letters T.E.N....OF..HE.ART..S printed on edges 27 of group 21. The periods between the letters are absent from indicia 29 and have been inserted herein only to indicate the number of spaces between letters. Likewise, second indicia 30 is provided on edges 25 of the cards provided in group 22. Indicia 30 takes the form in the embodiment shown in FIG. 3 of the letters H...AME....T...C..c.I printed on the edges. The periods between the letters also are absent from indicia 30 and have been inserted herein only to indicate the number of spaces between letters. Indicia 29 and 30 are therefore visible by being placed on the vertical surface formed by edges 27 and 25 of groups 21 and 22.

The cards in groups 21 and 22 are combined in alternate fashion to form deck 20. For example, the top card in deck 20 is the uppermost card of group 21, the second card from the top in deck 20 is the uppermost card in deck 22, the third uppermost card in deck 20 is the second uppermost card in deck 21, the fourth uppermost card in deck 20 is the second uppermost card in deck 22 with the remaining cards being positioned in similar alternate fashion. The letters in indicia 29 are positioned along the length of edge 29 so that the first letter T in indicia 29 is automatically positioned immediately to the left of the letter H in indicia 30 when groups 21 and 22 are mixed together in alternate fashion.

Figure 4:
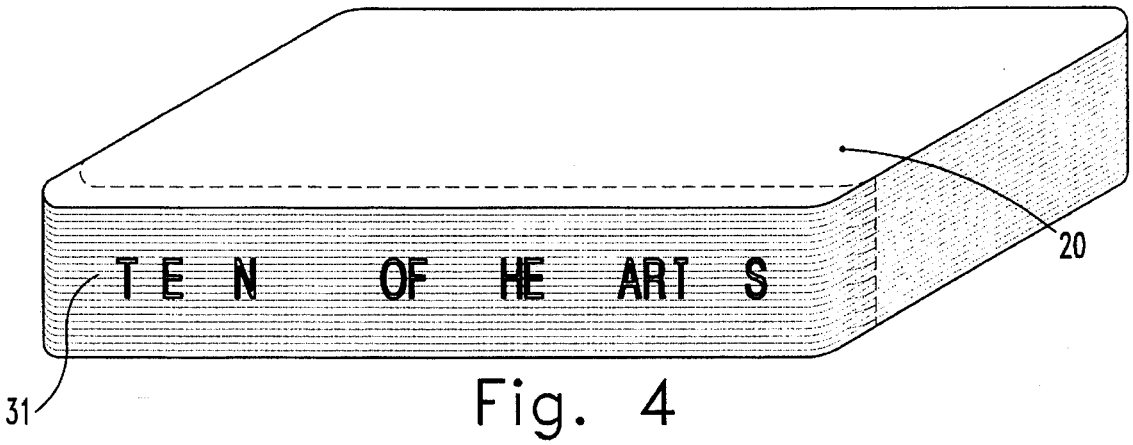
FIG. 4 is a perspective view of the deck of playing cards of FIG. 1 with the narrow cards of FIG. 3 in a recessed position.

Two different messages are therefore possible for displaying on vertical surface 31 of deck 20 which is formed by the edges of groups 21 and 22. The first message is depicted in FIG. 1 with the message being "THE NAME OF THE CARd IS" whereas the second message appearing on vertical surface 31 (FIG. 4) of deck 20 is "T E N OF HE ART S." The two messages are obtained by aligning or misaligning edges 27 of group 21 relative to edges 25 of group 22. More specifically, by vertically aligning edges 25 and 27 together so that each edge 25 is vertically aligned with each edge 27, the first message "THE NAME OF THE CARd IS" appears on surface 31. The second message "T E N OF HE ART S" appears by vertically aligning edges 26 and 28 together which automatically vertically misaligns edges 25 and 27. That is, since the cards in group 22 are narrow as compared to the cards in group 21, edges 25 will be recessed sufficiently so that indicia 30 is not visible thereby providing visualization on surface 31 only of indicia 29 providing the message "T E N OF HE ART S."

The preferred embodiment of the card deck is shown in FIGS. 5–8. Deck 40 includes 52 playing cards with one portion of the cards forming a group or stack 41 and the remaining cards forming a second group or stack 42. In the case shown in the drawings, each group 41 and 42 includes 26 cards with each card having a tapered shape. For example, the upper most card 43 of group 41 includes a pair of parallel end edges 44 and 45 and a pair of diverging side edges 46 and 47 with the edges diverging as the edges extend from end edge 44 to end edge 45.

The vertical surface 48 formed by the aligned edges 46 of group 41 have provided thereon indicia 49. In an example shown in FIG. 6, indicia 49 spells the message "T E N OF HE ART S." The letters "T E N OF HE ART S" are spaced apart in the identical manner as previously described for the alternate embodiment of FIGS. 1–4. Likewise, the vertical surface 59 formed by the aligned edges 50 of the cards forming group 42 have indicia 51 provided thereon composed of the letters H AME T C c I with the spacing between letters as described for the alternate embodiment.

Figure 5:
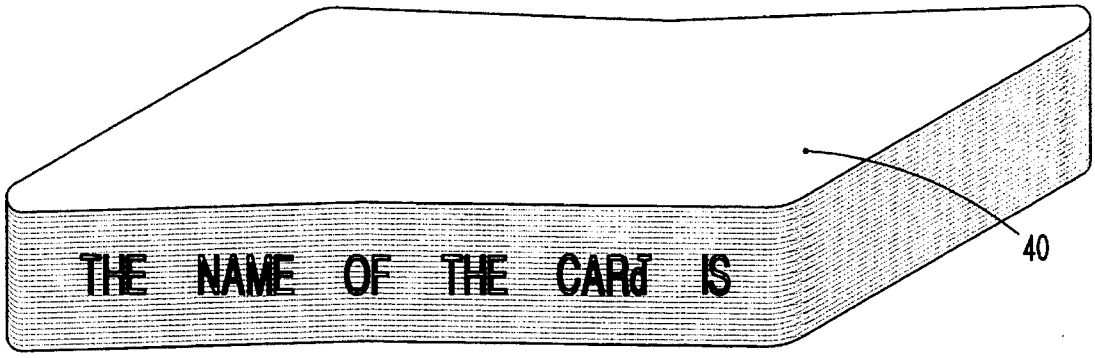
FIG. 5 is a perspective view of the preferred embodiment of the deck of playing cards incorporating the present invention.
Figure 6:
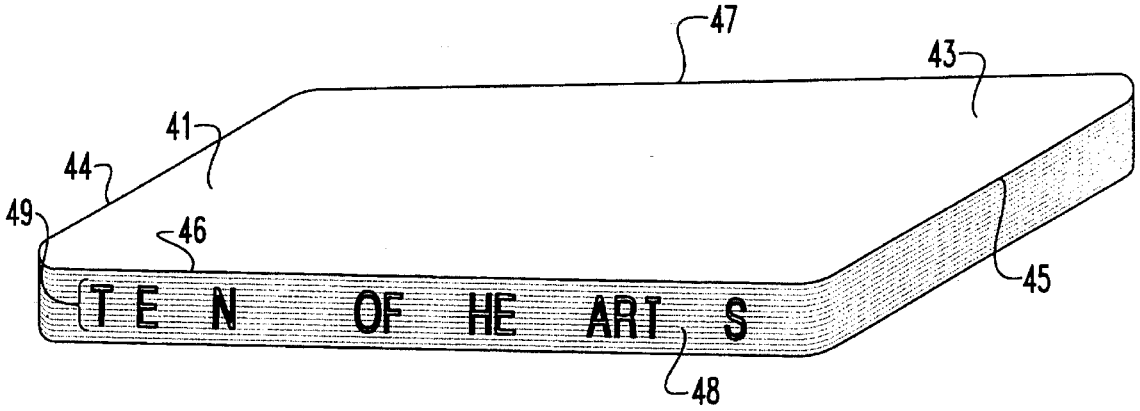
FIG. 6 is a perspective view of a first group of cards contained in the deck of FIG. 5.
Figure 7:
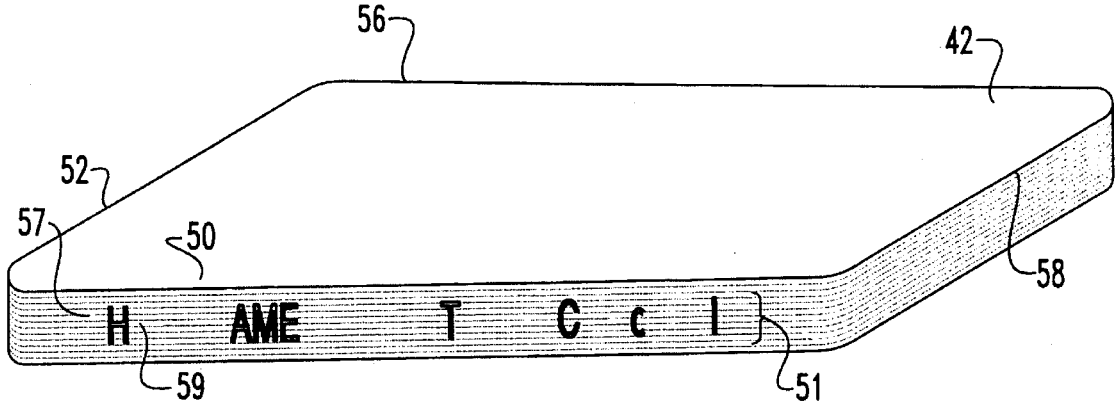
FIG. 7 is a perspective view of a second group of cards contained in the deck of playing cards of FIG. 5.
Figure 8:
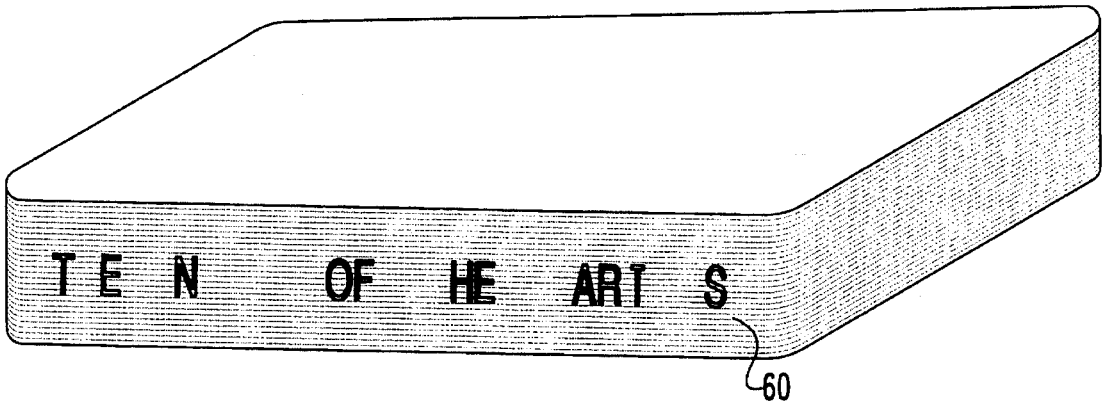
FIG. 8 is a perspective view of the deck of FIG. 5 only with the cards shown in FIGS. 6 and 7 aligned together.

The playing cards of group 41 are mixed with the playing cards of group 42 in alternate fashion as previously described for the embodiment of FIGS. 1–4. By mixing the cards of groups 41 and 42 together so that end edges 52 of the cards in group 42 are vertically aligned with edges 44 of the cards of group 41, indicia 49 and 51 combined to form the message "THE NAME OF THE CARD IS" as shown in FIG. 5. That is, group 41 and 42 are mixed together as shown in FIG. 5 with the wide ends or edges 52 of group 42 located to the left of the deck as viewed in FIG. 5 whereas the wide ends or edges 45 of group 41 are located to the right of deck 40 as viewed in FIG. 5. More specifically, in order to provide the message "THE NAME OF THE CARD IS," the wide end or edges 52 are vertically aligned with the narrow end or edges 44 of group 41 so that edges 46 are adjacent edges 50. In order to change the message from the message depicted in FIG. 5 to the message depicted in FIG. 8, the sides 56 and 57 adjacent the wide ends or edges 52 of group 42 are gripped and pulled to the left as viewed in FIG. 5 with all of the cards of group 42 being removed from the deck. Group 42 is then rotated 180° relative to group 41 and positioned atop group 41 vertically aligning the narrow ends or edges 58 of group 42 vertically with respect to the narrow ends or edges 44 of group 41 thereby providing the message "T E N OF HE ART S" on the vertical surface 60 of the deck.

All of the letters or indicia 29, 30, 49 and 51 are capital letters with the exception of the second "c" in indicia 30 and 51. The second "c" is of small case and is designed to be positioned to the lower left of the last "T" in indicia 29 and 49 to form the small case letter "d" in the word "card." More specifically, the capital letter "T" in the word "art" in indicia 29 cooperatively forms with the lower case second "c" in indicia 30 to form the lower case "d" in the word CARd. The lower case "d" is formed when the vertical edges 25 and 27 are aligned or when edges 46 and 50 are close together.

The letters of each indicia must be positioned to appropriately form the required message. That is, the first letter "H" in indicia 30 and 51 are positioned longitudinally to be positioned between the first letters "T" and "E" of indicia 29 and 49. The letters "AME" are positioned longitudinally to be positioned between the letter "N" and "O" of indicia 29 and 49, the letter "T" of indicia 30 and 51 is positioned between the letters "F" and "H" of indicia 29 and 49, the letter "C" of indicia 30 and 51 is positioned between the letters "E" and "A" of indicia 29 and 49, the small case letter "c" is positioned to the immediate left of the second letter "T" in indicia 29 and 49 and the letter "I" of indicia 30 and 51 is positioned immediately before the letter "S" of indicia 29 and 49.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A deck of playing cards comprising:

a plurality of wide playing cards each having a first edge with said wide playing cards positioned aligning said first edge of each wide playing card with each other forming a plurality of aligned first edges;

a plurality of narrow playing cards each having a second edge with said narrow playing cards positioned aligning said second edge of each narrow playing card with each other forming a plurality of aligned second edges, said narrow playing cards and said wide playing cards mixed together forming a deck of playing cards with said plurality of aligned first edges alternating with said plurality of aligned second edges;

a first message formed by first indicia on said first edges of said wide playing cards when said first edges are aligned together but apart from said second edges; and, a second message formed by second indicia on said second edges of said narrow playing cards spelled out cooperatively with said first indicia when said second edges are aligned together with said first edges with said second message different from said first message.

2. The deck of playing cards of claim 1 wherein:

said wide playing cards each have a first width; and said narrow playing cards each have a second width less than said first width.

3. The deck of playing cards of claim 2 wherein:

at least a portion of said first indicia cooperatively with at least a portion of said second indicia form a single letter when said second edges are aligned together with said first edges.

4. The deck of playing cards of claim 2 wherein:

said first indicia and said second indicia each include a plurality of letters with some of said letters of said first indicia located between some of said letters of said second indicia when said second edges are aligned together with said first edges.

5. The deck of playing cards of claim 4 wherein:

said wide playing cards and said narrow cards each have the same length.

6. The deck of playing cards of claim 5 wherein:

at least a portion of said first indicia cooperatively with at least a portion of said second indicia form a single letter when said second edges are aligned together with said first edges.

7. The deck of playing cards of claim 6 wherein:

said first message is "ten of hearts" and the second message is "the name of the card is".

8. A deck of playing cards comprising:

a plurality of first playing cards each having a first edge with said first playing cards positioned aligning said first edge of each first playing card with each other forming a plurality of aligned first edges;

a plurality of second playing cards each having a second edge with said second playing cards positioned aligning said second edge of each second playing card with each other forming a plurality of aligned second edges, said second playing cards being narrower than said first playing cards and being mixed together in alternate fashion;

first indicia on said first edges of said first playing cards spelling out a first message when said first edges are aligned together; and, second indicia on said second edges of said second playing cards spelling out cooperatively with said first indicia a second message different from said first message when said second edges are adjacent said first edges.

9. The deck of playing cards of claim 8 wherein:

said first playing cards and said second playing cards have narrow ends and opposite wide ends, said narrow ends of said first playing cards are located adjacent said narrow ends of said second playing cards when said first indicia spells said first message whereas said narrow ends of said first playing cards are located apart from said narrow ends of said second playing cards when said second indicia spell out cooperatively with said first indicia a second message, said first playing cards and said second playing cards are identical in size.

10. The deck of playing cards of claim 9 wherein:

said first playing cards and said second playing cards when mixed together form a deck of playing cards, said deck has a first edge portion and a second edge portion, said first indicia on said first edges of said first playing cards spell out a first message when said first edges are aligned together apart from said second edges of said second playing cards with said first edges located on said first edge portion of said deck and said second edges located on said second edge portion of said deck.

11. The deck of playing cards of claim 10 wherein:

said first indicia and said second indicia each include a plurality of letters with some of said letters of said first indicia located between some of said letters of said second indicia when said second edges are adjacent said first edges.

12. The deck of playing cards of claim 11 wherein:

said first playing cards and said second cards each have the same length.

13. The deck of playing cards of claim 8 wherein:

said first playing cards are wide playing cards with a first width and said second playing cards are narrow playing cards with a second width less than said first width.

14. A message apparatus comprising:

a plurality of first members each having a first edge with said first members positioned aligning said first edge of each first member with each other forming a plurality of aligned first edges;

a plurality of second members each having a second edge with said second members positioned aligning said second edge of each second member with each other forming a plurality of aligned second edges, said second members being narrower than said first members and being mixed together interspersing said first edges with said second edges;

first indicia on said first edges of said first members spelling out a first message when said first edges are aligned together but apart from said second edges; and, second indicia on said second edges of said second members spelling out cooperatively with said first indicia a second message different from said first message when said second edges are aligned together with said first edges.

15. The message apparatus of claim 14 wherein:

said first indicia and said second indicia each include a plurality of letters with some of said letters of said first indicia located between some of said letters of said second indicia when said second edges are aligned together with said first edges.

* * * * *